United States Patent [19]

Chapman

[11] 4,136,997

[45] Jan. 30, 1979

[54] FLOATING WALL OIL CONTAINER

[76] Inventor: Marcus R. Chapman, 711 Marshall St., Plaquemine, La. 70764

[21] Appl. No.: 739,936

[22] Filed: Nov. 8, 1976

[51] Int. Cl.[2] ..... B65G 5/00; E21F 17/16

[52] U.S. Cl. ..... 405/210; 114/256; 220/18

[58] Field of Search ..... 61/0.5, 1 R, 48, 63, 61/86; 114/256, 264, 267; 220/18, 1 R, 1.5, 3

[56] References Cited

U.S. PATENT DOCUMENTS

| | | | |
|---|---|---|---|
| 744,694 | 11/1903 | Sewall | 61/0.5 X |
| 2,391,059 | 12/1945 | MacFarren | 114/267 |
| 2,798,633 | 7/1957 | Cornell et al. | 220/18 X |
| 2,924,350 | 2/1960 | Greer | 220/18 X |
| 2,976,691 | 3/1961 | Edholm | 61/0.5 |
| 3,102,503 | 9/1963 | Sheffield | 114/266 |
| 3,230,967 | 1/1966 | Castro | 61/0.5 X |
| 3,306,053 | 2/1967 | Fulton | 61/48 |
| 3,327,667 | 6/1967 | Manning | 114/256 |
| 3,504,496 | 4/1970 | Hnot | 61/0.5 |
| 3,516,568 | 6/1970 | Fish | 61/0.5 X |
| 3,727,418 | 4/1973 | Glazier | 61/0.5 X |
| 3,774,563 | 11/1973 | Anderson | 114/256 |
| 3,782,124 | 1/1974 | Pladys | 61/0.5 |
| 3,844,122 | 10/1974 | Bliss | 114/256 X |

*Primary Examiner*—Dennis L. Taylor

[57] ABSTRACT

A floating wall container for holding liquids having a specific gravity less than that of water, the container being suitable for inland storage or liquids such as oil in lowland or march areas, or wherever there is a constant supply of water, the container being held in position by pilings, and buoyed by floating barges in a cavity dredged for this purpose.

8 Claims, 11 Drawing Figures

FLOATING WALL OIL CONTAINER

This invention relates in general to a tank for holding liquids having a specific gravity less than that of water, such as oil.

In accordance with this invention, it is proposed to provide a floating wall tank which includes a continuous peripheral wall which is mounted on permanent piling in water of a generally constant depth with the tank wall being vertically movable on the piling but otherwise fixedly positioned thereby. The tank wall is supported by a plurality of floating barges which are interlocked therewith and serve to maintain the wall partially within the water and partially projecting therefrom.

In accordance with this invention, there are provided inlet means for filling the floating container and discharge means, the discharge means being of a nature wherein stored liquids may be substantially entirely removed from the surface of the supporting water.

The floating container is mounted within a confined water area normally defined by a surrounding dike having a weir which is several inches below high tide so that the level of the water within the dike remains substantially constant.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
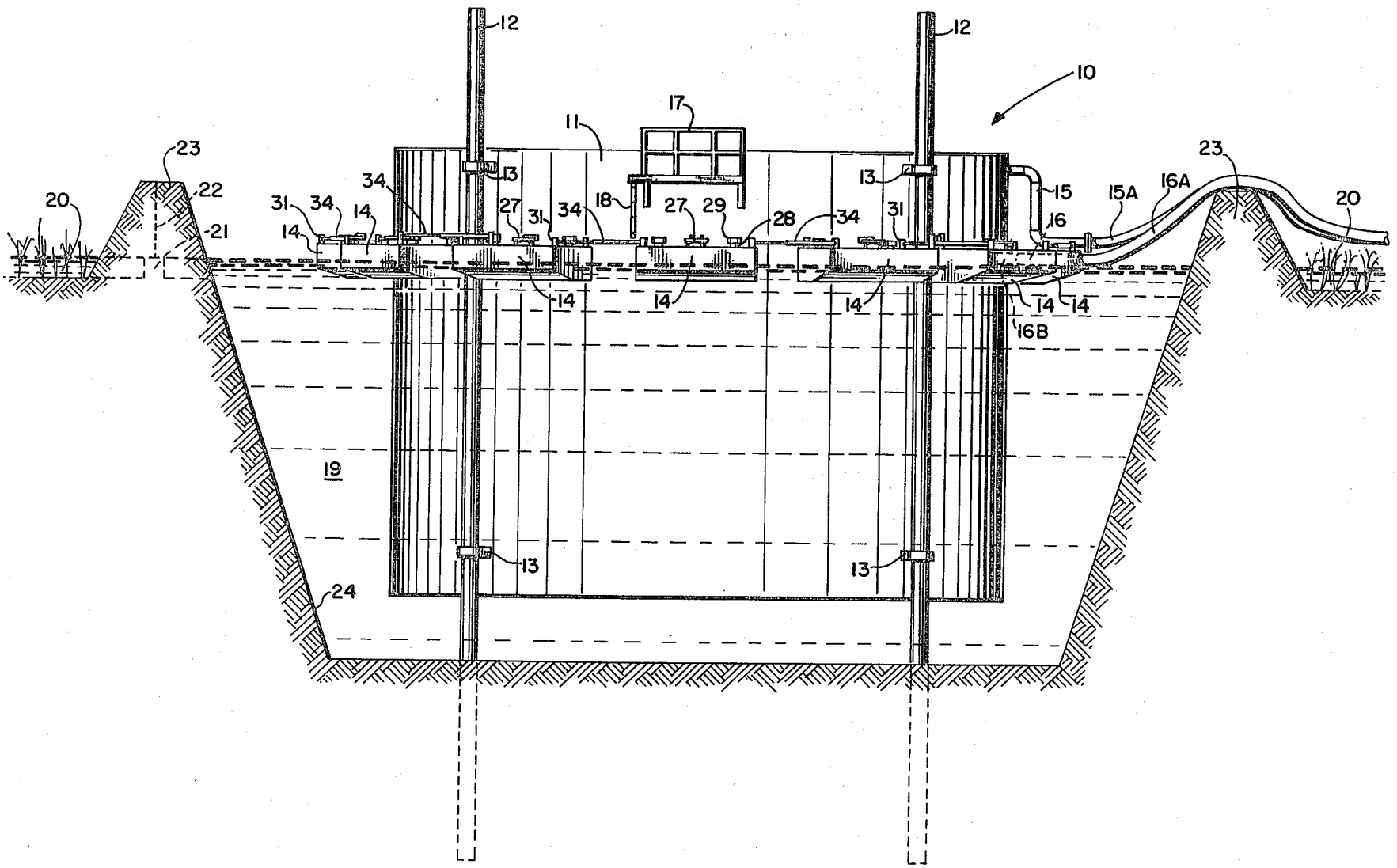
FIG. 1 is a sectional view through an impounding dike having mounted therewithin a floating container in accordance with this invention.

Referring now to the drawings in detail, it will be seen that there is illustrated a floating container formed in accordance with this invention, the container being generally identified by the numeral 10. The container 10 includes a continuous peripheral wall 11 which is positioned against lateral movement by a plurality of piles or piling 12. As best shown in FIG. 1, the wall 11 is provided adjacent the upper and lower edges thereof with ring brackets or collars 13 which are slidably mounted on the piling 12.

In order to effect the floating of the wall 11 and to support the same vertically in a body of water, there is provided a plurality of barge floats 14 which are spaced around the exterior of the wall 11.

Figure 10:
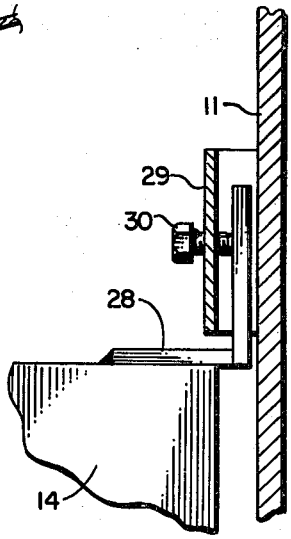
FIG. 10 is an enlarged fragmentary vertical sectional view taken along the line 10—10 of FIG. 6, and shows specifically the details of a connection between a tank and the container wall.
Figure 7:
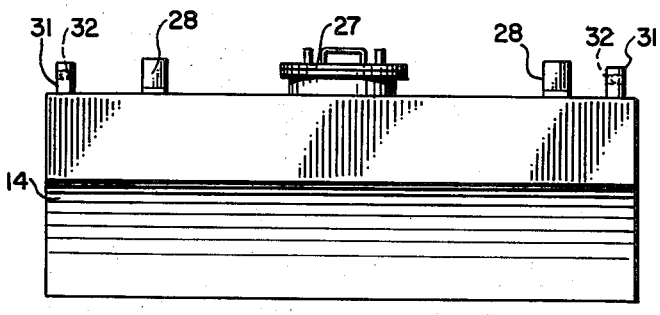
FIG. 7 is a side elevational view of the tank of FIG. 6.
Figure 8:
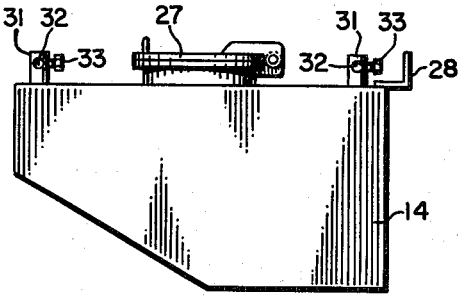
FIG. 8 is an end elevational view of the tank of FIG. 6.
Figure 9:
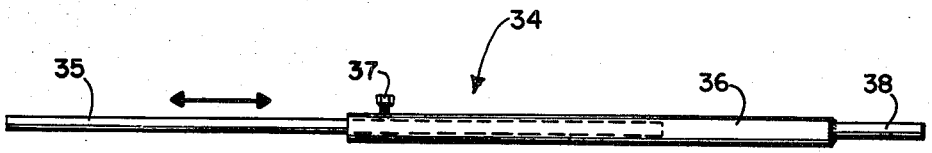
FIG. 9 is an enlarged elevational view of a tie rod used for interconnecting adjacent tanks.

Referring now to FIGS. 2 and 6–10, it will be seen that each barge float 14 is hollow and is provided with an inspection hatch 27. In order that each float 14 may be suitably secured to the tank wall 11, each float is provided adjacent one edge thereof with a pair of angle brackets 28, each including an upstanding leg. Further, the wall 11 is provided with a pair of brackets 29 spaced in accordance with the spacing of the angle brackets 28. The brackets 29 are so shaped as to define a relatively deep socket for receiving the upstanding leg of an associated bracket 28, as shown in FIG. 10. The relatively deep socket of each bracket 29 permits the deformation of the wall 11 while facilitating the reception of the legs of the brackets 28. Each bracket 29 is provided with a clamping bolt 30 which forcibly engages the upstanding leg of the associated bracket 28 fixedly to secure each float to the wall 11.

The floats are connected together by tie rods generally identified by the numeral 34. Each tie rod 34 includes a shaft 35 which is slidably received in a tubular shaft 36 and is retained in adjusted position by means of a set screw or bolt 37. The opposite end of the shaft 36 is provided with an extension shaft 38.

The tie rods 34 are secured to respective floats 14 by means of swivel pins 31 carried by the upper wall of each float. The swivel pins 31 are disposed at the corners of the floats and each has a bore 32 for receiving an end of a respective tie rod 34. Each swivel pin 31 is provided with a bolt 33 opening into the bore 32 for fixedly securing the tie rod in the bore 32.

Referring once again to FIG. 2, it will be seen that those floats 14 disposed on opposite sides of one of the pilings 12 are interconnected by tie rods 34 disposed in crossing relation, while others of the floats are connected together by tie rods arranged in generally parallel relation.

Figure 4:
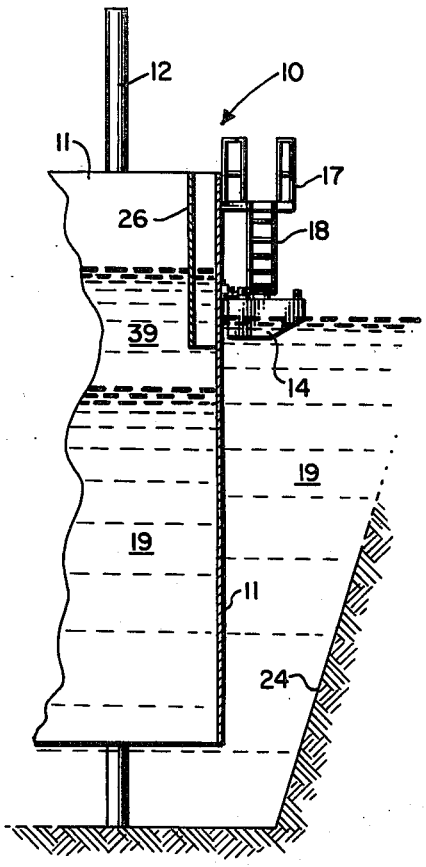
FIG. 4 is a fragmentary vertical sectional view taken along the line 4—4 of FIG. 2, and shows the details of a platform and associated ladder.

As is best shown in FIGS. 1 and 4, the wall 11 is provided with an inspection platform 27 which is secured to the exterior thereof. The inspection platform has a ladder 18 leading down to a position adjacent an underlying one of the floats 14.

In order that the liquid to be stored may be placed within the wall 11, there is provided a filling line 15 having attached thereto a flexible hose 15A. The filling line 15 is attached to and opens through the upper part of the wall 11 within a baffled area defined by a baffle 25. This baffle may have an extension 26, as shown in FIG. 4, should a floating roof be desired.

Figure 5A:
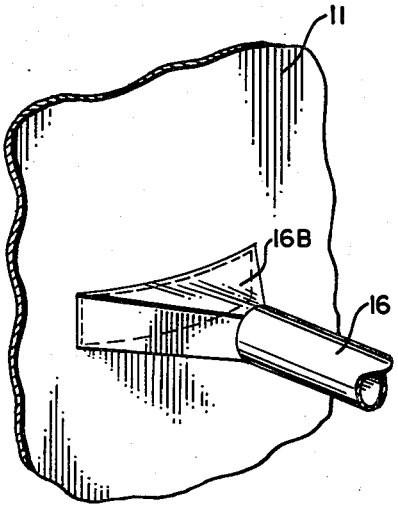
FIG. 5A is an enlarged fragmentary perspective view showing more specifically the details of the discharge means.
Figure 5:
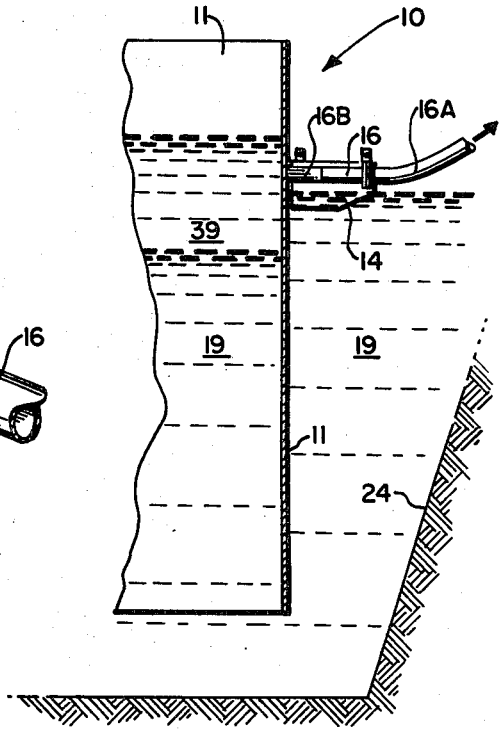
FIG. 5 is a vertical sectional view taken along the line 5—5 of FIG. 2, and shows the details of the means for discharging stored liquid.
Figure 6:
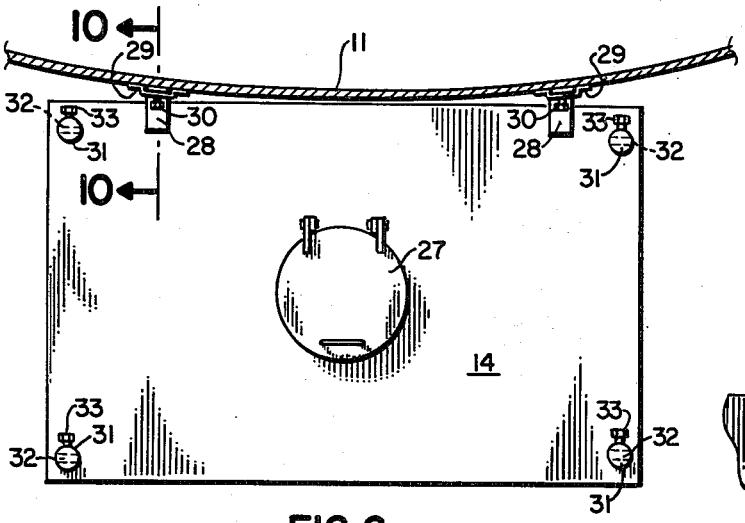
FIG. 6 is an enlarged fragmentary horizontal sectional view taken through the tank wall above one of the floats, interconnecting means between adjacent floats being omitted.

It is to be understood that the vertical position of the wall 11 will be established by the floats 14. In order that stored liquid may be removed from the container 10, there is provided a suction line 16 which has a transition piece 16B secured to and opening through the wall 11 substantially at the water line thereof, as shown in FIGS. 5 and 5A. A flexible hose 16A leads from the wall 11.

Figure 2:
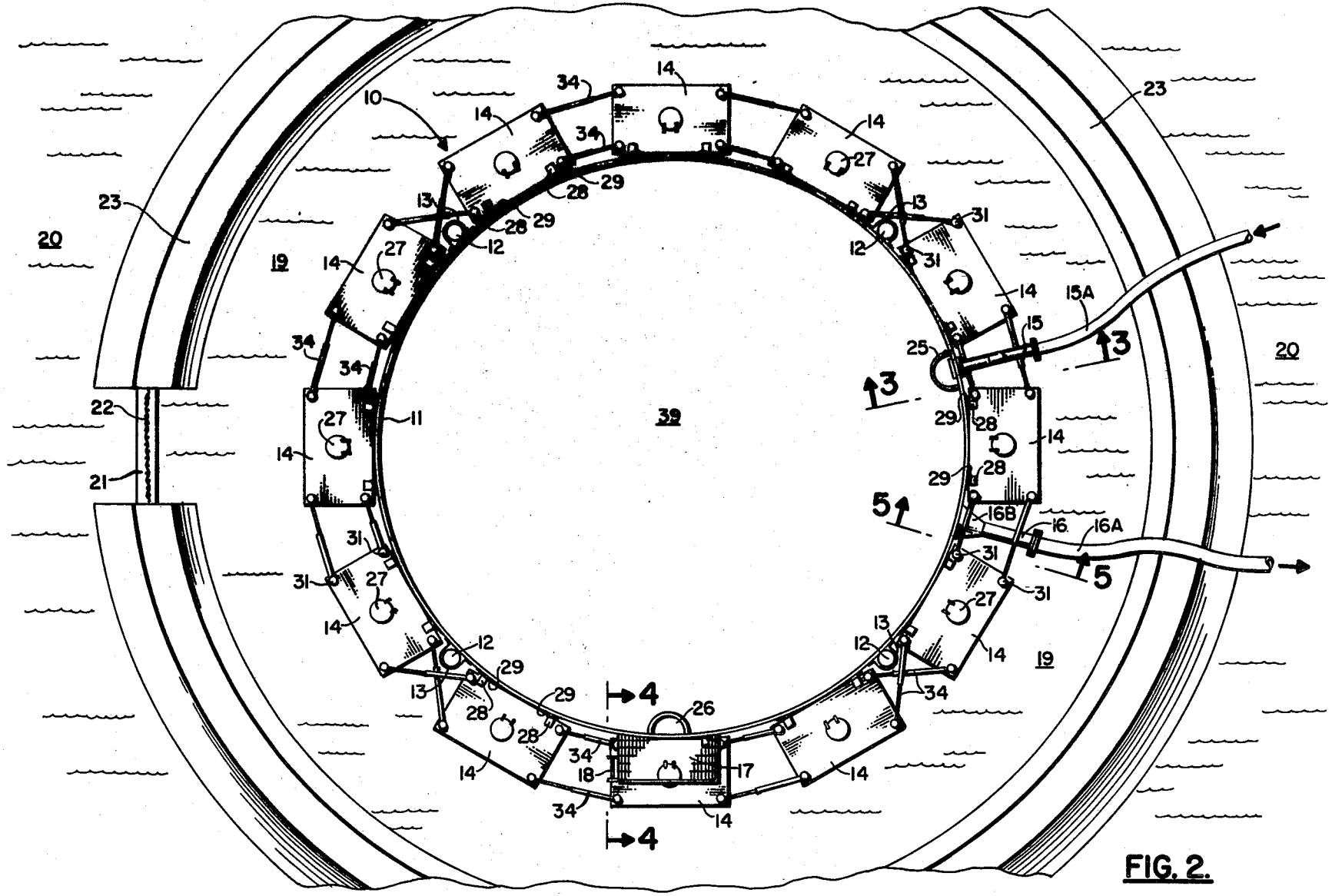
FIG. 2 is a fragmentary top plan view of the floating container and dike of FIG. 1.
Figure 3:
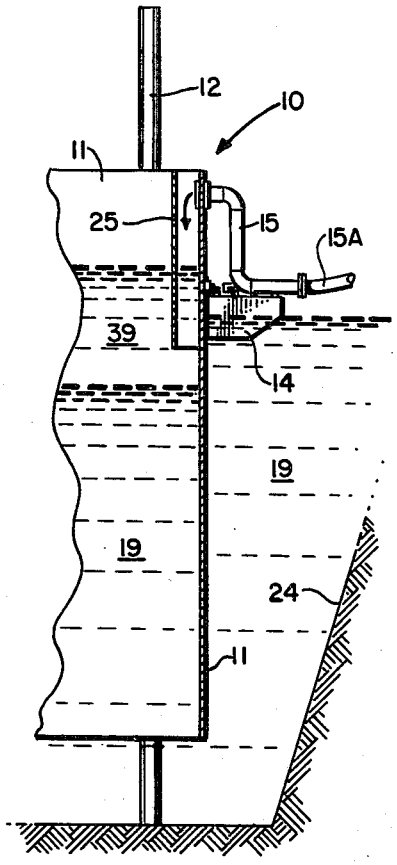
FIG. 3 is a fragmentary vertical sectional view taken along the line 3—3 of FIG. 2, and shows the details of inlet means for the container.

As shown in FIGS. 1 and 2, the tank 10 is floating in confined water 19 which may be located in marsh or lowland. The normal water level of the marsh or lowland is identified by the numeral 20.

A dike 23 may be formed by dredging the lowland or marsh area so as to define a relatively deep receptacle or cavity 24 for the container 10. The dike is constructed to surround the container 10 at a height of one foot or more above the highest tide for the area. The dike 23 includes a weir 21 having thereabove a screen 22. The top of the weir should be six inches below high tide so as to keep the water 19 in the cavity 24 near a constant level. Any variation in the level of the water 19 within the cavity 24 will be compensated for by the rising and falling of the container 10 with the wall 11 sliding relative to the piling 12.

It is to be understood that the specific gravity of the oil or the liquid stored determines the depth of that liquid within the container 10. The wall 11 is supported by the floats 14 so that approximately one-fourth of the wall is above the water level and three-fourths of the wall is below the water level. Thus, a tank wall forty feet in height stands approximately ten feet above the water level and approximately thirty feet below the water level. Such a tank will hold a column of oil 39 approximately twenty-five feet high safely.

At this time it is pointed out that if desired the weir 21 may be equipped with hinged flaps (not shown) to prevent outflow of water from the cavity 24 and keep the level of the water 19 therein at a more stable level. It is also pointed out here that the swivel connection pins 31 could be constructed differently from those illustrated and described, and could be in the form of any suitable connecting means such as the ball and socket tie rods of automotive steering mechanisms.

What is claimed is:

1. A floating wall oil container comprising an upstanding continuous peripheral wall having free upper and lower edges, a plurality of vertical pilings positioned at spaced intervals around said wall, sliding connections attached to said wall and slidably mounted on said pilings, said connections restricting movement of said wall to vertical movement, a plurality of individual floats adjustably interconnected around said wall, said floats being interconnected by a pair of adjustable tie rods extending between said adjacent pair of floats, and there is a swivel connection between said tie rod and associated float and bracket means releasably connecting each of said floats to said wall.

2. The oil container of claim 1 wherein a pair of tie rods extend between each adjacent pair of floats, each piling being positioned intermediate a pair of adjacent ones of said floats, and those tie rods adjacent each piling being arranged in crossing relation.

3. The oil container of claim 2 wherein tie rods of other pairs of tie rods are in generally parallel spaced apart relation.

4. The oil container of claim 1 wherein said wall is positioned solely by said piling and said floats.

5. The oil container of claim 1 wherein said bracket means are of the type including an angle bracket having a free leg and a slot forming bracket receiving said free leg, said slot having a dimension normal to said wall materially greater than the thickness of said free leg to compensate for curvature of said wall.

6. The oil container of claim 1 wherein said wall has a preselected water line, and there are discharge means attached to said wall at said water line to facilitate the complete removal of all oil from said oil container.

7. The oil container of claim 1 wherein said wall is mounted in tidal water, a dike surrounds said wall and floats in spaced relation, and said dike has a weir disposed a selected small distance below high tide whereby the level of water in which said wall is mounted remains generally constant.

8. The oil container of claim 1 wherein each of said floats has an upwardly and outwardly sloping bottom remote from said wall.

* * * * *